US009140509B2

(12) United States Patent
Sullivan et al.

(10) Patent No.: US 9,140,509 B2
(45) Date of Patent: Sep. 22, 2015

(54) EVIDENCE COLLECTING AND RECORDING APPARATUS FOR A GUN

(71) Applicants: Kevin Michael Sullivan, Kennebunk, ME (US); Karl F. Milde, Jr., Mahopac, NY (US)

(72) Inventors: Kevin Michael Sullivan, Kennebunk, ME (US); Karl F. Milde, Jr., Mahopac, NY (US)

( * ) Notice: Subject to any disclaimer, the term of this patent is extended or adjusted under 35 U.S.C. 154(b) by 0 days.

(21) Appl. No.: 13/855,891

(22) Filed: Apr. 3, 2013

(65) Prior Publication Data

US 2014/0215885 A1 Aug. 7, 2014

Related U.S. Application Data

(63) Continuation-in-part of application No. 13/763,951, filed on Feb. 11, 2013, now Pat. No. 8,893,420.

(60) Provisional application No. 61/761,270, filed on Feb. 6, 2013.

(51) Int. Cl.

| | |
|---|---|
| ***F41A 19/00*** | (2006.01) |
| ***F41A 17/06*** | (2006.01) |
| ***F41A 35/00*** | (2006.01) |

(52) U.S. Cl.
CPC ..... *F41A 17/066* (2013.01); *F41A 17/063* (2013.01); *F41A 35/00* (2013.01)

(58) Field of Classification Search
CPC ..... F41A 17/063
USPC ..... 42/84, 1.01
See application file for complete search history.

(56) References Cited

U.S. PATENT DOCUMENTS

| | | | | |
|---|---|---|---|---|
| 5,479,149 | A * | 12/1995 | Pike | 340/539.1 |
| 6,823,621 | B2 * | 11/2004 | Gotfried | 42/70.06 |
| 7,525,568 | B2 * | 4/2009 | Raghunath | 348/61 |
| 7,714,720 | B2 * | 5/2010 | Hietanen et al. | 340/568.1 |
| 2004/0246127 | A1 | 12/2004 | Junqua | |
| 2006/0042142 | A1 * | 3/2006 | Sinha | 42/1.01 |
| 2008/0066362 | A1 * | 3/2008 | Fidlow | 42/90 |
| 2011/0126622 | A1 * | 6/2011 | Turner | 73/514.01 |

* cited by examiner

*Primary Examiner* — Reginald Tillman, Jr.
(74) *Attorney, Agent, or Firm* — Karl F. Milde, Jr.

(57) ABSTRACT

A battery-powered electronic evidence-collecting device on the gun that transmits to a smartphone or other device carried by the peace officer for recording and forwarding the evidence to a central station. The evidence collecting and recording apparatus is activated by the removal of the gun from its holster.

8 Claims, 2 Drawing Sheets

EVIDENCE COLLECTING AND RECORDING APPARATUS FOR A GUN

CROSS-REFERENCE TO RELATED APPLICATION

This application claims priority from Provisional Application No. 61/761,270 filed Feb. 6, 2013, entitled "SECURE SMARTPHONE-OPERATED GUN TRIGGER LOCK" and utility patent application Ser. No. 13/763,951, filed Feb. 11, 2013 and entitled "SECURE SMARTPHONE-OPERATED GUN TRIGGER LOCK".

BACKGROUND OF THE INVENTION

The present invention relates to an evidence collecting and recording apparatus for collecting and preserving evidence about the use of a gun.

When a police officer or a security guard discharges a gun while on duty there is always an investigation as to why the gun was used and whether the use of potentially lethal force was absolutely necessary under the particular circumstances that occurred. Questions of responsibility and liability are raised, especially when there was an injury or death resulting from this use of force.

Before a gun is discharged, the police officer or security guard must remove it from its holster in readiness to shoot. Under these circumstances the official is frequently in danger but is unable to call for assistance or "backup" because of the fast-moving pace of the events or because stealth is necessary to avoid revealing his or her presence at the scene.

SUMMARY OF THE INVENTION

It is a therefore principal object of the present invention to provide apparatus that automatically collects and records evidence of the use of a gun by a peace officer or some other person who is licensed or otherwise authorized to use the weapon.

It is a further object of the invention to provide apparatus that automatically places a call for assistance when a gun is removed from its holster.

These objects, as well as other objects which will become apparent from the discussion that follows, are achieved, in accordance with the present invention, by providing a battery-powered, electronic evidence-collecting device on the gun that transmits to a smartphone or other device carried by the peace officer for recording the evidence. Preferably, this evidence collecting and recording apparatus is activated by the removal of the gun from its holster and, also preferably, the apparatus causes the smartphone to automatically place a call for assistance when the gun is removed from its holster.

According to a preferred embodiment of the invention, the evidence collecting apparatus on the gun comprises:

(1) at least one sensor for sensing gun-related data;
(2) a first digital logic device, coupled to the sensor or sensors, for receiving and forwarding the gun-related data; and
(3) a wireless transmitter ("T") device, coupled to the first logic device, for transmitting the gun-related data received from the logic device.

According to the present invention the evidence recording apparatus includes a portable device, such as a smartphone, that comprises:

(1) a wireless receiver ("R") device, for receiving the gun-related data from the T device;

(2) a wireless telephone device correctable to a telephone network for transmitting data to a central station via the network; and
(3) a second digital logic device, coupled to the R device for receiving and forwarding the gun-related data to the central station.

Advantageously, the evidence collecting and recording apparatus further comprises a gun holster for holding the gun and one of the first sensors includes a device for determining when said gun is removed from said holster.

Advantageously too, the portable device includes a data memory, coupled to the second logic device, for recording the evidence received by transmission from the data collecting apparatus prior to uploading it to the central station.

According to another preferred embodiment of the invention, the second logic device is programmed to automatically initiate a call for assistance upon receipt of gun-related data from the evidence-collecting device.

According to still another preferred embodiment of the present invention, the gun is provided with one or more of the following evidence collecting sensors:

(i) a holster sensor for sensing that the gun is removed from a holster;
(ii) a video camera arranged to view forward in the direction of aim of the gun and/or in the direction of the holder of the gun;
(iii) a microphone arranged to receive sounds in the vicinity of the gun; and
(iv) a direction finder for determining the direction of aim of the gun.

Finally, according to still another preferred embodiment of the present invention, the portable device is provided with one or more of the following evidence collecting devices:

(i) a clock for determining the time that the gun is removed from the holster; and
(ii) a GPS for determining the location of the gun when it is removed from the holster.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
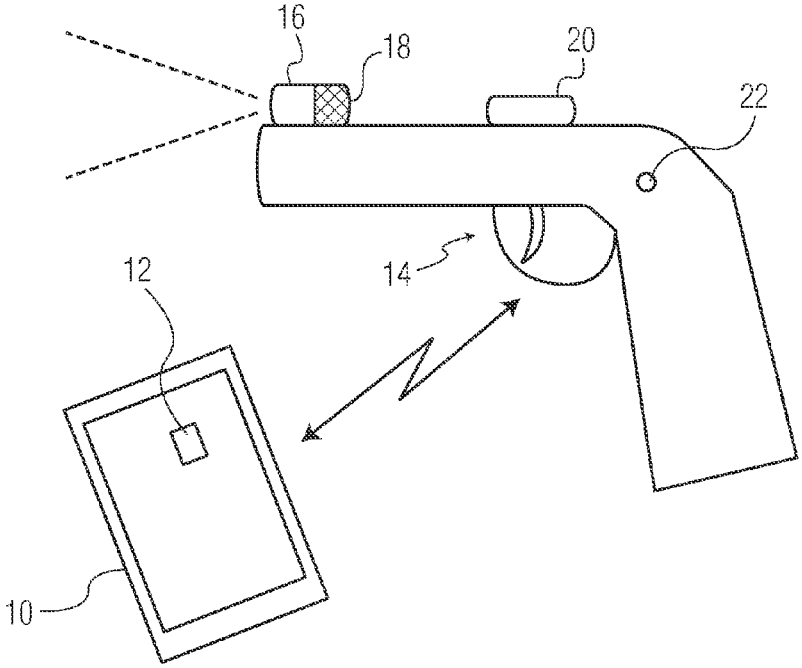
FIG. 1 is a representational diagram showing a smartphone and a gun that is equipped with an electronic evidence-collecting device according to the present invention.

The preferred embodiments of the present invention will now be described with reference to FIGS. 1-3 of the drawings. Identical elements in the various figures are identified with the same reference numerals.

FIG. 1 shows a battery-operated portable device such as a smartphone 10 having an application or "app" 12 which may be selected by the user or run continuously in the background during when the user is "on duty" as a peace officer. The portable device communicates wirelessly, for example by bluetooth protocol, with an evidence-collecting device on a handgun 14. The evidence-collecting device includes a number of sensors 16, 18, 20 and 22 connected to a logic device with a (e.g. Bluetooth) transmitter.

The sensors include:

(1) a video camera 16 arranged to view in the direction of aim of the gun 14;

(2) a microphone 18 arranged to receive audio from the user of the gun;

(3) a direction finder 20 arranged to detect the direction in which the gun is aimed; and (4) a light or other type sensor 22 arranged to detect when the gun has been removed from a holster.

Figure 2:
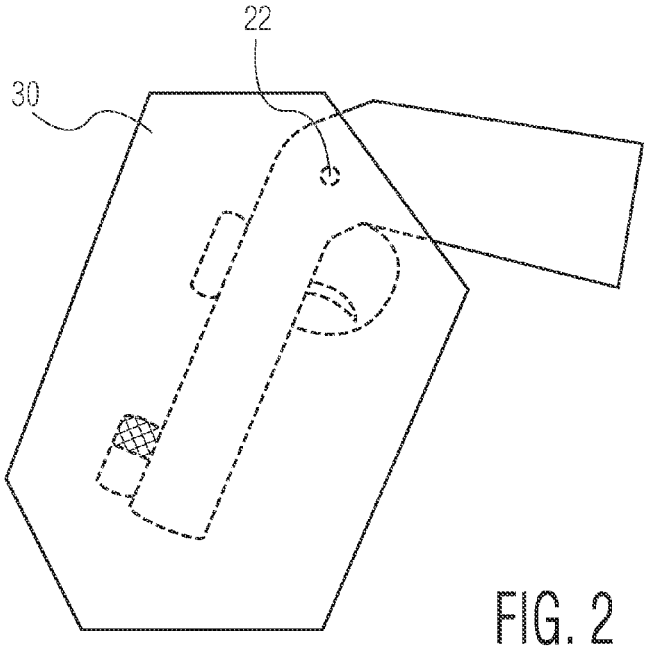
FIG. 2 is a close-up view of the gun of FIG. 1 arranged in a holster.

As shown in FIG. 2, the light sensor 22 is covered when the gun is holstered. When removed from its holster 30, the sensor 22 receives light and detects this removal. Output from the light sensor 22 initiates the collection of gun-related data from the other sensors 16, 18 and 20.

Figure 3:
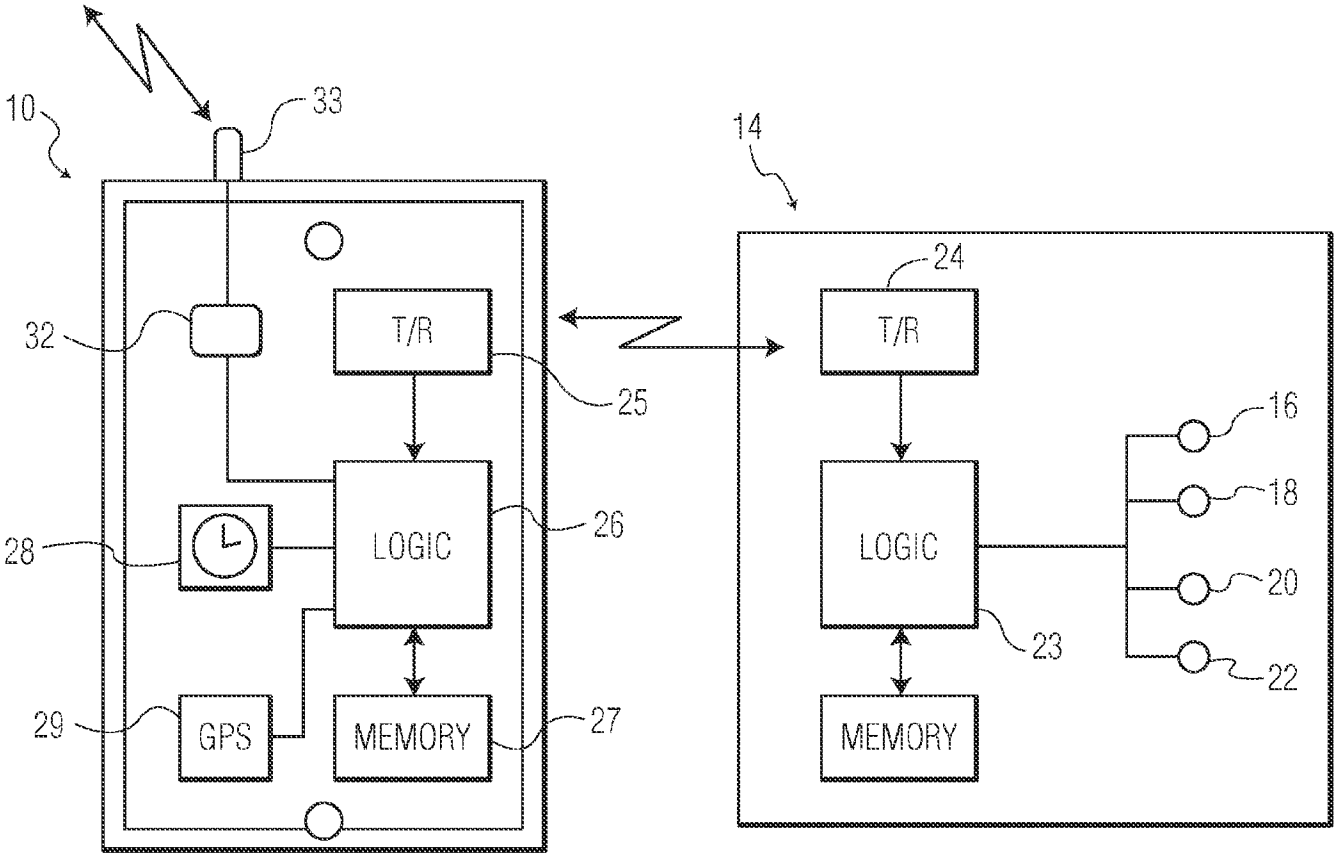
FIG. 3 is a block diagram showing a preferred embodiment of the evidence collecting and recording apparatus according to the present invention.

FIG. 3 is a block diagram showing the evidence-collecting device on the gun 14 and the portable device 10 to which it transmits. The evidence-collecting device includes a number of sensors 16, 18, 20 and 22 all connected to a logic device 23 which is activated upon removal of the gun from its holster and forwards the sensed, gun-related data via a first transmitting ("T") device 24 to the portable device 10.

The portable device 10 receives the gun-related data via a second T/R device 25 and a second logic device 28 and temporarily records this data in a memory 27. Thereafter, the portable device 10 uploads the gun-related data via its cell phone transmitter 32 and antenna 33 to a central station (not shown).

Immediately upon receipt of a signal that the user's gun has been removed from its holster, the logic device 26 automatically causes the portable device 10 to make a cell phone call to the user's partner and/or to the central station to request assistance and backup. The portable device (e.g., smartphone) can also automatically commence taking pictures or shooting a video, and can start recording sound from its own camera and microphone, respectively. If the phone is located on the shoulder of the peace officer, for example, or if it is held in the officer's hand, it can collect important evidence at this critical time.

When so activated and when recording the gun-related data transmitted from the gun in its memory 27, the portable device 10 can also record the exact time and location of the event using its internal clock 28 and GPS locator 29.

There has thus been shown and described a novel evidence collecting and recording apparatus for a gun which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A firearm system with anevidence collecting and recording apparatus for collecting and preserving evidence of an event relating to the use of a hand gun when it is removed from a holster, said evidence collecting and recording apparatus comprising, in combination:

(a) a gun having a muzzle and including an electronic evidence collecting device with a first source of electrical power, said evidence collecting device comprising the following components coupled to said first source of power:

(1) a video camera, mounted on the muzzle of the gun, for producing a video signal representing video information obtained from the location of the gun;

(2) a first digital logic device, coupled to said video camera, for enabling the transmission of said video information to a receiving device;

(3) a wireless transmitting ("T") device, coupled to said first logic device, for transmitting said video information to a wireless receiving ("R") device; and (4) a sensor, coupled to said first logic device, for determining when the gun is removed from the holster, wherein said first logic device is operative activate the video camera and to cause said T device to transmit said video information to the R device when said sensor determines that the gun is removed from the holster; and (b) a portable smartphone including a second source of electrical power and comprising the following components coupled to said second source of power:

(1) an R device for receiving said video information from said T device;

(2) a digital data memory for storing said video information received by said R device;

(3) a wireless telephone device connectable to a telephone network for transmitting information to a central station at a remote location via said network; and (4) a second digital logic device, coupled to said R device, to said data memory and to said telephone device;

wherein said smartphone further includes a phone app operative to control said second logic device to store said video information in said data memory and to cause said telephone device to forward said video information to said central station at said remote location via said telephone network.

2. The apparatus defined in claim 1, wherein said evidence collecting device further for producing a sound signal representing sound information obtained from the location of the gun, wherein said sound information is transmitted by said T device to said R device in addition to said video information for forwarding to said central station.

3. The apparatus defined in claim 1, wherein the smartphone further includes a clock for determining the time that the gun is used and wherein said phone app is operative to cause said second logic device to store said time in the data memory along with the video information.

4. The apparatus defined in claim 1, wherein said phone app is further operative to cause said second logic device to automatically initiate a call for assistance when the gun is removed from the holster.

5. The apparatus defined in claim 1, wherein the smartphone further includes location finding means for determining its global position and wherein the phone app is operative to cause said second logic device to store digital location information in the data memory along with the video information.

6. The apparatus defined in claim 1, wherein the smartphone further includes a microphone for transducing sounds and wherein the phone app is operative to cause said second logic device to store digital sound information in the data memory along with the video information.

7. The apparatus defined in claim 1, wherein the smartphone further includes a second video camera for recording a scene wherein said phone app is operative to cause said second logic device to store digital scene information captured by said second video camera in the data memory along with the video information received from the evidence collecting device.

8. The apparatus defined in claim 1, wherein said evidence collecting device further comprises a direction finder for determining the direction of aim of the gun and producing a direction signal representing said direction information, wherein said direction information is transmitted by said T device to said R device in addition to said video information for forwarding to said central station.

* * * * *